US006039404A

United States Patent [19]

Fontana

[11] Patent Number: 6,039,404

[45] Date of Patent: Mar. 21, 2000

[54] STRUCTURE FOR SUSPENSION IN ARTICLES OF FURNITURE OR THE LIKE AND METHOD FOR THE ASSEMBLY OF SAID STRUCTURE

[75] Inventor: Anacleto Fontana, Lesmo, Italy

[73] Assignee: Cintal S.a.s. di Fontana Paola & C, Monza, Italy

[21] Appl. No.: 09/047,737

[22] Filed: Mar. 25, 1998

Related U.S. Application Data

[63] Continuation of application No. PCT/EP97/01864, Apr. 14, 1997.

[30] Foreign Application Priority Data

Sep. 19, 1996 [IT] Italy ..... MI96A1929

[51] Int. Cl.[7] ..... A47C 7/02

[52] U.S. Cl. ..... 297/452.64; 297/452.5

[58] Field of Search ..... 297/452.64, 452.5, 297/452.63; 267/131; 5/191, 186.1, 243, 230

[56] References Cited

U.S. PATENT DOCUMENTS

| | | | |
|---|---|---|---|
| 979,158 | 12/1910 | Hallock | 5/191 |
| 3,107,944 | 10/1963 | Baermann | 297/452.64 X |
| 5,544,943 | 8/1996 | Durling | 297/452.64 X |
| 5,570,874 | 11/1996 | Tornero | 297/452.5 X |
| 5,700,060 | 12/1997 | Bullard et al. | 297/452.5 X |

FOREIGN PATENT DOCUMENTS

| | | |
|---|---|---|
| 354092 | 10/1921 | Germany . |
| 647208 | 2/1935 | Germany . |
| 806571 | 4/1951 | Germany . |
| 250039 | 10/1947 | Switzerland . |

*Primary Examiner*—Milton Nelson, Jr.
*Attorney, Agent, or Firm*—Cobrin & Gittes

[57] ABSTRACT

A suspension structure for parts destined to support the human body in articles of furniture or the like, comprising at least one pair of elastic-interwoven straps, positioned in tension between two opposite sides of the frame of the article of furniture, in which the first and the second strap of the pair of straps are superimposed and linked together to form a space inside of which is lodged at least one spiral spring.

8 Claims, 1 Drawing Sheet

STRUCTURE FOR SUSPENSION IN ARTICLES OF FURNITURE OR THE LIKE AND METHOD FOR THE ASSEMBLY OF SAID STRUCTURE

This is a continuation of PCT/EP97/01864, filed Apr. 14, 1997.

TECHNICAL FIELD

The present invention relates to a suspension structure for parts destined to support the human body in articles of furniture such as chairs, armchairs, couches, both for private and public use, such as waiting rooms, cinemas etc. The Invention can also be applied to seats for motor vehicles and the like.

The present invention further relates to a method for the assembly of said suspension structure to the said articles of furniture and the like.

BACKGROUND ART

The articles of furniture such as the aforementioned ones to which the present invention could be applied, are normally composed by a support and a padding. The support could be made from wood, metal or plastic material and comprise at least one frame to which are fixed the aforesaid structures or the means of suspension destined to support, at least in part, the human body.

The suspension structure could be produced by a variety of techniques known in the art, for instance from a plurality of metal springs, from strips of leather or wooden battens connected transversely to the frame. In some cases cloth straps are used, provided where necessary with the means for varying the tension of said straps. However, these structures often present problems owing to the complexity of the assembly operations. Moreover, the aforementioned techniques often don't give optimum durability characteristics to the product.

A second type of suspension provides for the use of pre-tensioned elastic-interwoven straps, which are applied to the frame during manufacture of the article of furniture. The straps are applied to the frame in predetermined positions, often with a crossing pattern. Solutions of this type, while presenting better reliability and better durability, don't give the finished product the classic padded upholstered effect which can be obtained with metal springs, and which is much appreciated by buyers, both for its aesthetic value and for the impression it offers of better anatomical adaptability to the seated position.

The Patent Application PCT WO 96/14782 in the name of the applicant describes a system of suspension comprising at least one elastic-interwoven strap, which is fixed, in pre-tensioned condition, above a rigid U-shaped support. This U-shaped support is fixed to the frame of the article and one or more springs in compression are inserted between the base of the U-shaped support and the strap in tension, in adjustable positions.

Such structure produces an upholstered effect of the type obtainable with traditional springs. Moreover, assembly of the suspension structure does not have to be to carried out by the manufacturer, being an operation that could be done instead by the buyer or the wholesaler. The latter solution however requires of the use of at least one rigid element, for instance an angle-iron, which is generally expensive.

DISCLOSURE OF THE INVENTION

The purpose of the present invention is to resolve the aforementioned problems through a structure for suspension in articles of furniture or the like that offers a high level of comfort to the user; could be fitted in a simple way, even by the buyer or the wholesaler; is economical to produce, and has long durability.

Such purpose is achieved by the present invention which relates to a suspension structure for parts destined to support the human body in articles of furniture or the like, of the type comprising at least one pair of elastic-interwoven straps, positioned in tension between two opposite sides of the frame of the article of furniture or the like, characterized by the first and the second strap, belonging to the said at least one pair of straps, being superimposed and linked together, to form a space inside of which is lodged at least one spiral spring.

According to a preferential embodiment of the present invention, two or more pairs of straps are arranged substantially parallel to two opposite sides of the frame of said article of furniture or the like.

According to a further aspect of the present invention, the elements composing the suspension structure can be interlinked, without spiral springs, to form a roll that facilitates the transport of said elements before assembly onto the article of furniture.

The suspension structure according to the present invention offers the advantage firstly of giving a very comfortable seat since it is able to support the legs of the user in a slightly elevated position; secondly, the structure is easy and quick to assemble onto the article, and could be fitted also by the wholesaler or the buyer. Finally the structure has high durability and resistance to wear.

BRIEF DESCRIPTION OF DRAWINGS

Further advantages and characteristics of the invention will become more evident from the following description, which is of illustrative but not limitative nature, with reference to the schematic sketches attached, in which:

- the FIG. 1 is a side view, partially in section, of a component element of the suspension structure according to the present invention, fitted to the frame of an article of furniture; and
- the FIG. 2 is a view in perspective of a suspension structure according to the present invention, applied to the seat of an article of furniture.

BEST MODE FOR CARRYING OUT THE INVENTION

Figure 1:
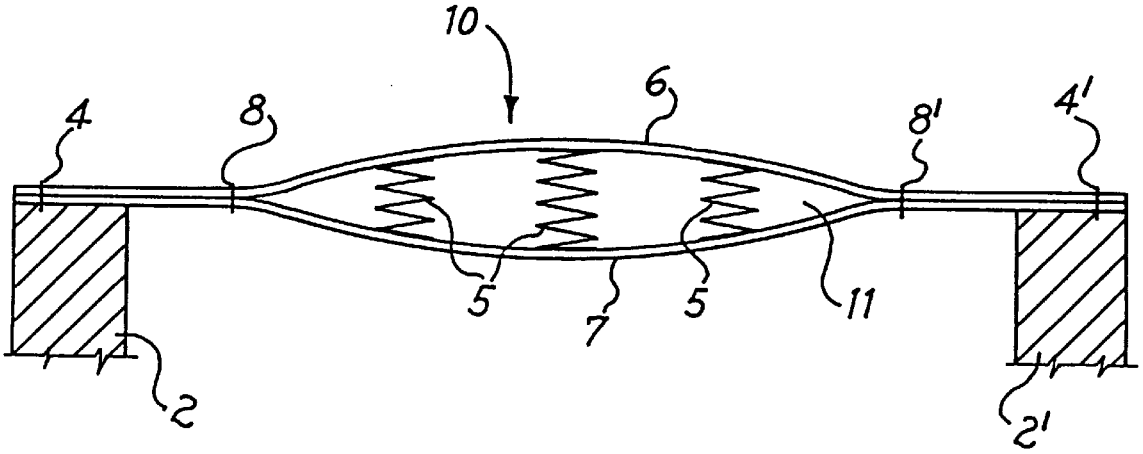

FIG. 1 shows an element 10 of the suspension structure 1 applied to two opposite sides 2 and 2' of the frame of an article of furniture. The element 10 comprises a first elastic-interwoven strap 6, and a second strap 7, analogous to the first strap 6. The first strap 6 is situated above to the second strap 7 and both the straps 6 and 7 are fixed to the sides 2 and 2' by staples or metal stitches 4 and 4,' or with any other known means. The two straps 6 and 7 are, moreover, linked together at the points 8 and 8,' by stitching or other known technique. This arrangement of the straps creates a space 11 inside of which is situated a plurality of spiral springs 5. The springs 5 could be fitted with a protective covering, for instance cloth or other similar material.

Figure 2:
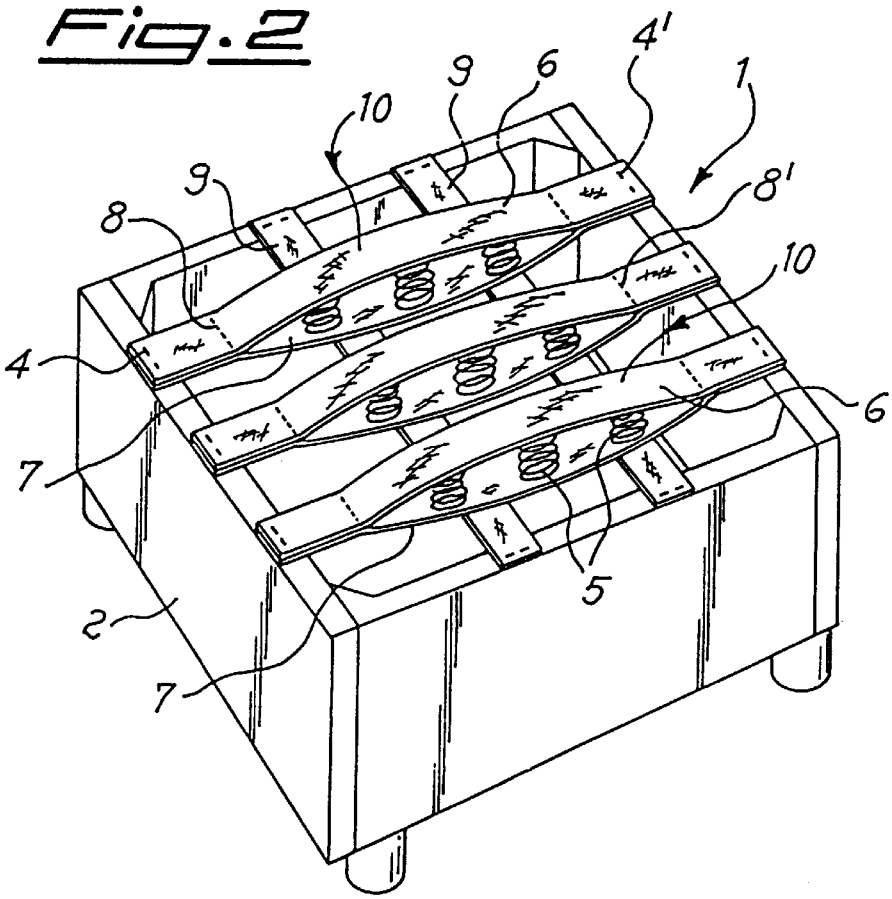

The suspension structure 1 according to the invention is produced by applying some elements 10, composed in the way previously described, to opposite sides 2 and 2' of a frame of an article of furniture, arranged substantially parallel, as shown in FIG. 2. Optionally, there could be some elastic-interwoven straps 9 in a position below the elements 10 and substantially perpendicular to them, for the purpose of producing better support for the elements 10.

The particular arrangement of the straps and springs of the present invention provides better support for the body of the user. Due to the aforesaid system of suspension, the legs of the user are supported in a slightly raised position. The application of one or more springs 5, inserted into the space 11 of each of the structures 10, produces an upholstered effect, desirable in the eyes of the user. Moreover, by varying the number of springs and their position inside the space 11, the comfort and aesthetic appearance of the seat of the article of furniture can be varied in an suitable way during the assembly phase of the suspension structure.

The elements 10 comprising the suspension structure 1 are, moreover, easily applied to the frame of the article of furniture. The elements 10 could be supplied to the buyer or to the wholesaler in the form of a roll. Such rolls are composed of a plurality of pairs of straps 6 and 7, connected end to end to form a ribbon, which is subsequently rolled up, while the springs 5 are supplied separately.

The assembly of the elements 10 to form the suspension structure 1 could be done by the buyer or the wholesaler, using the following method. First, the elements 10 comprising the suspension 1 are unrolled and separated. Then, the elements 10, without springs 5, are fixed to the frame of the said article of furniture, for instance using metal staples or other analogous technique. Finally, some springs 5 are applied to each element 10, in suitable positions inside the space 11 formed by the said pair of superimposed straps 6 and 7.

An alternative assembly method consists of unrolling a portion of the said rolled-up ribbon to free an extremity of an element 10, and fixing said extremity of the element 10 by means of metal staples or other suitable technique, to the first side 2 of the frame. The rolled-up ribbon is partially unrolled to free the element 10 completely, the opposite extremity of which is fixed, by means of the aforementioned means of connection, to the side 2' of the frame. The element 10 is then separated from the rolled-up ribbon by means of a cutting operation. To each of the elements 10 thus fixed in position are added at least one spring 5, contained inside a cloth sheath, which are fixed, by means of metal staples or other suitable means of connection to the straps 6 and 7, which compose the said element 10. In this case, it is not necessary that the straps 6 and 7 be joined together by means of the stitches 8 and 8.' To the structure so formed, there could be in addition the elastic straps 9, which are positioned below the elements 10 and are substantially perpendicular to them. The elastic straps 9 could be linked to said elements 10, for instance by means of metal staples.

The suspension structure according to the invention allows wide flexibility in construction and application.

For instance, if it is necessary produce a seat with a classic upholstered finish for studio couches and/or divans, three springs 5 can be fixed in suitable positions for each element of suspension 10.

A second example of application of the present invention is given by the production of a seat for motor vehicles, in which it is important that the thigh of the user be in a raised position. In this case it is possible fix a single spring 5 for each element of suspension 10, positioning each of such springs 5 in the front part of the seat.

In a preferential embodiment of the present invention, the straps 6 and 7 are produced with different degrees of rigidity. In particular, in most applications of the present invention, the less rigid strap is positioned above the more rigid strap, respectively in positions 6 and 7 of FIG. 1. It is possible, however, in the case where a flatter seat is desired, to arrange the straps inversely as regards to the way described above, with the more rigid strap above the less rigid strap.

A preferential technique for producing straps of different rigidity consists of arranging different configurations of weft threads with respect to the warp threads according to the degree of rigidity that is required.

I claim:

1. A suspension structure in an article of furniture, comprising at least two pairs of elastic-interwoven straps positioned substantially parallel and in tension between two opposite sides of a frame of the article of furniture, at least one pair of the elastic-interwoven straps including a first strap and a second strap being superimposed and linked together to form a space, at least one spiral spring being lodged inside of the space, at least one elastic strap positioned below and substantially perpendicular to the two pairs of elastic-interwoven straps and being fixed to two opposite sides of the frame of the article of furniture.

2. Structure according to claim 1, characterized by springs being fixed to the straps directly.

3. Structure according to claim 1, characterized by the pairs of straps being attached by staples to the single elastic perpendicular straps.

4. Structure according to claim 1, characterized by said at least two pairs of elastic-interwoven straps each being fixed to the sides of the said frame by any one of metal staples, clips and hooks.

5. Structure according to claim 1, characterized by the first and the second strap of each of said two pairs of elastic-interwoven straps being linked together by means of stitching.

6. Structure according to claim 1, characterized by the first and the second strap of each of said two pairs of elastic-interwoven straps being linked together by means of attachment to the frame.

7. A suspension structure in an article of furniture, comprising at least one pair of elastic-interwoven straps positioned in tension between two opposite sides of a frame of the article of furniture, at least one pair of the elastic-interwoven straps including a first strap and a second strap being of different rigidities and being superimposed and linked together to form a space, at least one spiral spring being lodged inside of the space.

8. Structure according to claim 1, characterized by spring being fixed to the straps by staples, through the fixing of a sheath that contains the staples.

* * * * *